United States Patent [19]

Hill

[11] 4,182,645

[45] Jan. 8, 1980

[54] PRESSURE-SENSITIVE TAPE MACHINE WITH STRIPPER

[75] Inventor: Forrest G. Hill, East St. Louis, Ill.

[73] Assignee: Marsh Stencil Machine Company, Belleville, Ill.

[21] Appl. No.: 846,703

[22] Filed: Oct. 31, 1977

[51] Int. Cl.[2] ..... B32B 31/00

[52] U.S. Cl. ..... 156/361; 156/540; 156/584

[58] Field of Search ..... 156/584, 353, 360, 361, 156/540, 541, 542, 247

[56] References Cited

U.S. PATENT DOCUMENTS

| | | | |
|---|---|---|---|
| 2,754,994 | 7/1956 | Cole | 156/344 |
| 2,939,599 | 6/1960 | Schluter | 156/361 |
| 3,530,028 | 9/1970 | Messmer | 156/584 |
| 3,556,898 | 1/1971 | Allen | 156/541 |
| 3,586,578 | 6/1971 | Dickerson | 156/541 |
| 3,798,108 | 3/1974 | Ioannilli | 156/584 |
| 3,992,244 | 11/1976 | Craig et al. | 156/584 |

*Primary Examiner*—Douglas J. Drummond
*Attorney, Agent, or Firm*—Rogers, Eilers & Howell

[57] ABSTRACT

A liner-separating tape-feeding machine that automatically feeds pressure-sensitive tape from a supply roll, peels the liner off the tape, delivering the tape in one direction and the liner in another and separating the tape into predetermined lengths. The liner is peeled from the tape by being brought around an edge at an acute angle from the tape, while it is kept under tension by having its feed roller move at a greater peripheral speed than the feed roller for the unseparated tape. Means are provided for optional delivery of a selected length of tape each time a previous piece of tape is removed from the machine.

19 Claims, 9 Drawing Figures

PRESSURE-SENSITIVE TAPE MACHINE WITH STRIPPER

BACKGROUND OF THE INVENTION

Tape feeding machines have been devised that, by manual or power, feed various kinds of tapes to the user in selectable lengths. Some of them wetted a glue-covered face of the tape, others fed glue to the tape. Some have automatically fed a new strip whenever a former strip is lifted from the machine. None has successfully automatically fed strips of lined pressure-sensitive tape by removing the liner as the tape is fed. None has fed such pressure-sensitive tapes with automatic power-operated feed energized to feed a new strip whenever a former strip is lifted from the machine.

OBJECTS OF THIS INVENTION

A primary object of this invention is to overcome the difficulty of removing the liner from pressure-sensitive tape is an automatic tape feeding machine. Another object is to provide a machine that can strip the liner regardless of the length of the strip of tape being fed and severed from the supply roll.

Another object of the invention is to provide a machine of this kind that can be operated either manually or automatically, the latter to feed selected lengths of tape each time a piece of tape is removed from the machine.

Another object of the machine is to provide a pressure roller and housing assembly that can be mounted on the forward wall of a tape feeding machine. A further object is to provide a machine of this kind that can be adapted readily for use with existing tape feeding machines without excessive alterations in the existing machine.

Other objects include the provision of: specific means for driving the liner feed wheel at a greater peripheral speed than the tape feed wheel; means for providing for the separation of the liner from the tape and causing the liner to peel off at a sharp angle from the tape; means to provide for a slight adhesion of the strip of severed tape to the machine before it is lifted off, but without excessive adhesion, and to cause the presence of the severed tape strip on the machine to withhold the further feeding operation of the machine until the piece of tape is removed.

Other objects include the provision of means to render the mechanism accessible for service and repair.

Other objects will appear in the description to follow.

IN THE DRAWINGS

DESCRIPTION OF THE PREFERRED EMBODIMENT

Figure 1:
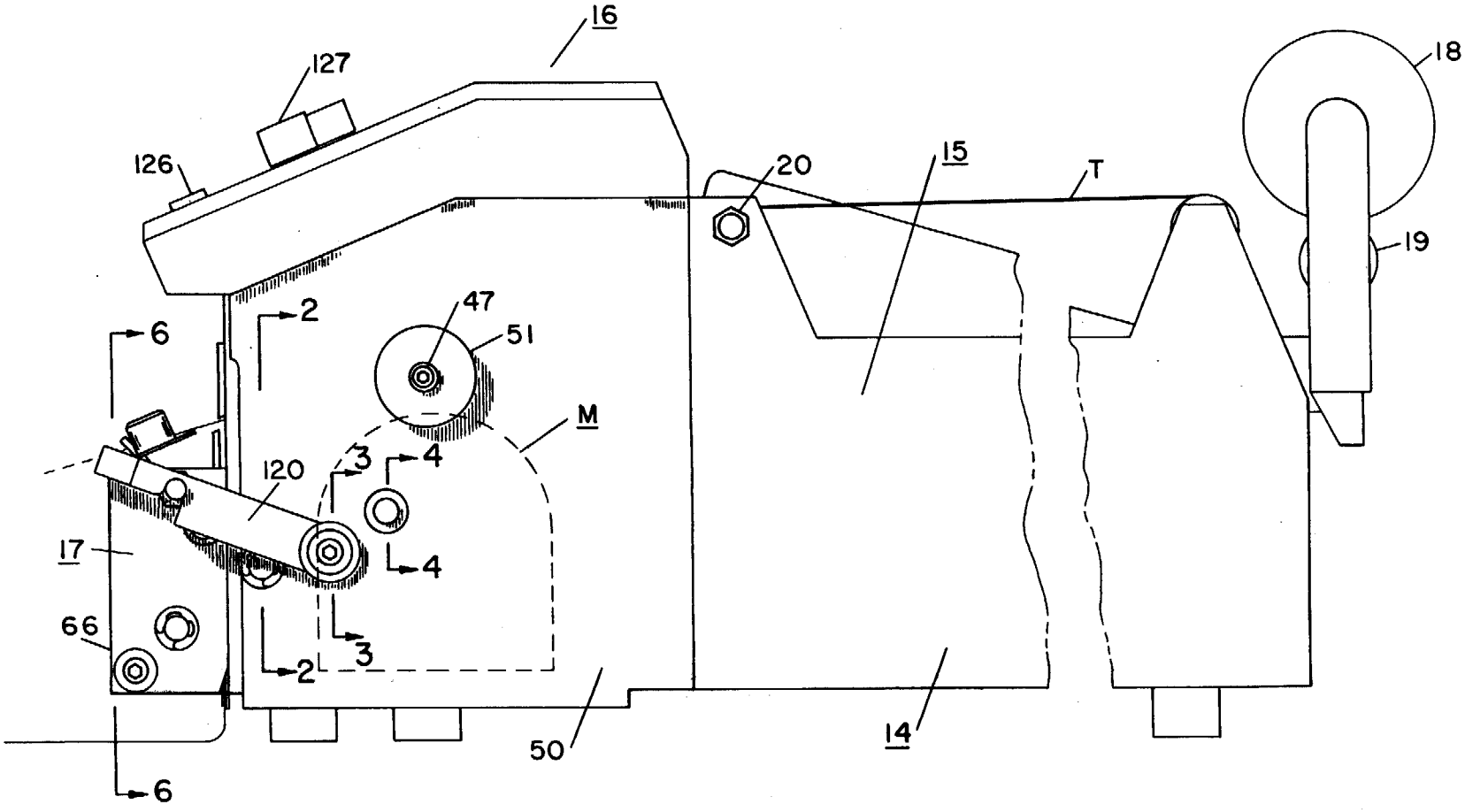
FIG. 1 is a side elevation of the machine, parts being broken away.

This machine uses components that may be substantially like or substantially identical to those in former patents owned by the assignee hereof, and particularly the patents to Hempel U.S. Pat. Nos. 2,757,730, Aug. 7, 1956, and to Hempel 2,845,266 of July 29, 1958. Parts of the mechanism are also similar to those in the U.S. Pat. Nos. to Hill 3,227,080, issued Jan. 4, 1966; to Hempel and Hill, 3,429,492; and to Hill 3,924,498, issued Dec. 9, 1975. Reference is made to all of these patents for such details.

The machine includes a sectional housing structure 14 preferably of metal and having an after section 15 which is a tape storage and printing section (see U.S. Pat. Nos. 2,845,266 and 3,227,080), a middle section 16 that contains the power operating mechanisms including the feed and cutoff devices, and a forward section 17 which is a liner pressure roller and housing assembly.

A roll of liner-type tape can be supported in the section 15 in the manner illustrated for the tape roll in the U.S. Pat. No. 2,757,730. A tape T is shown in the drawings. The actual details of the inking and printing mechanism are not shown because they are adequately disclosed in the other patents. See for example, U.S. Pat. No. 3,186,337. The printing wheel 18 and the transfer roller 19 correspond to the wheel assembly 93 and roller 121 of that patent.

Figure 8:
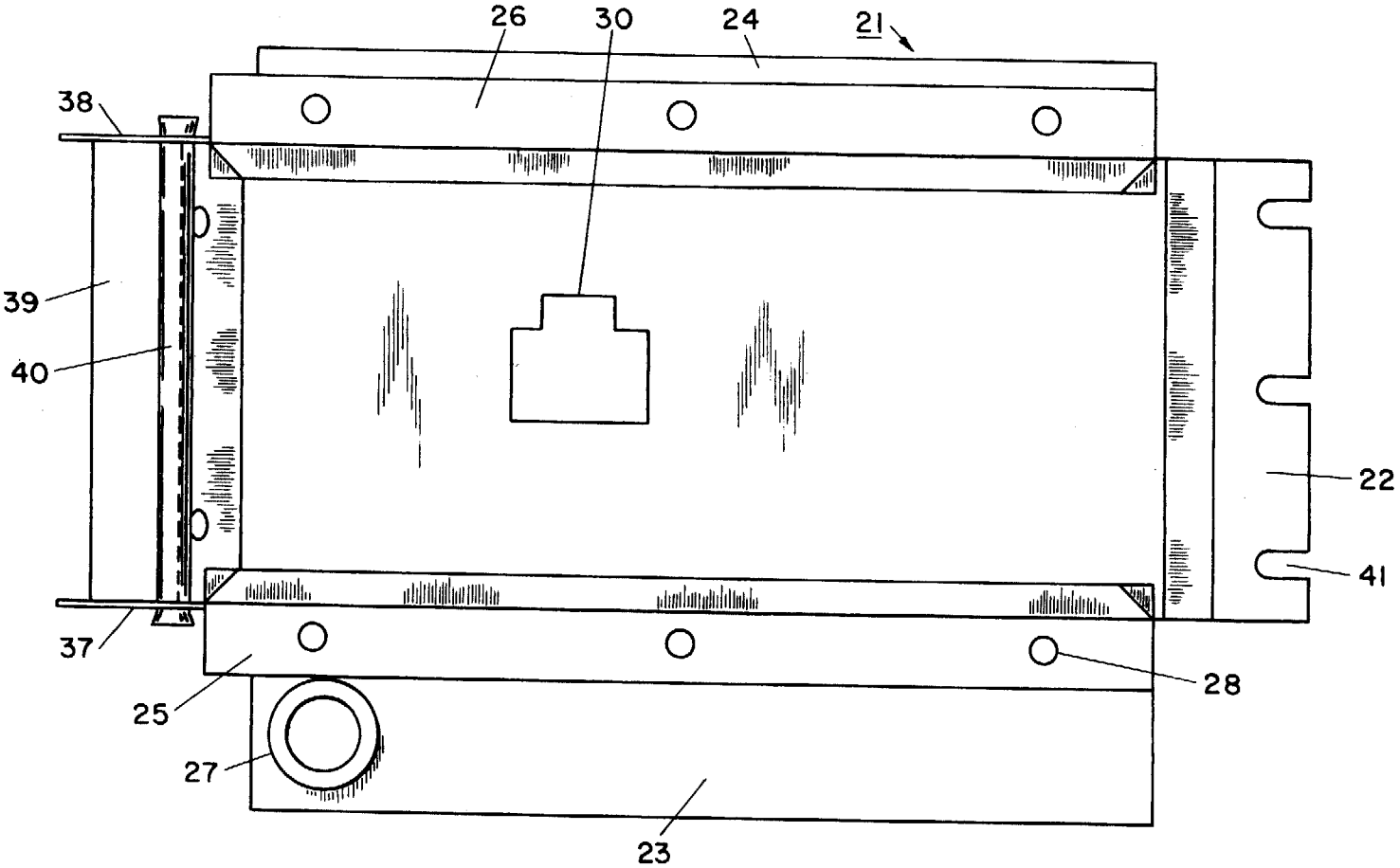
FIG. 8 is a plan view of the tape channel.
Figure 9:
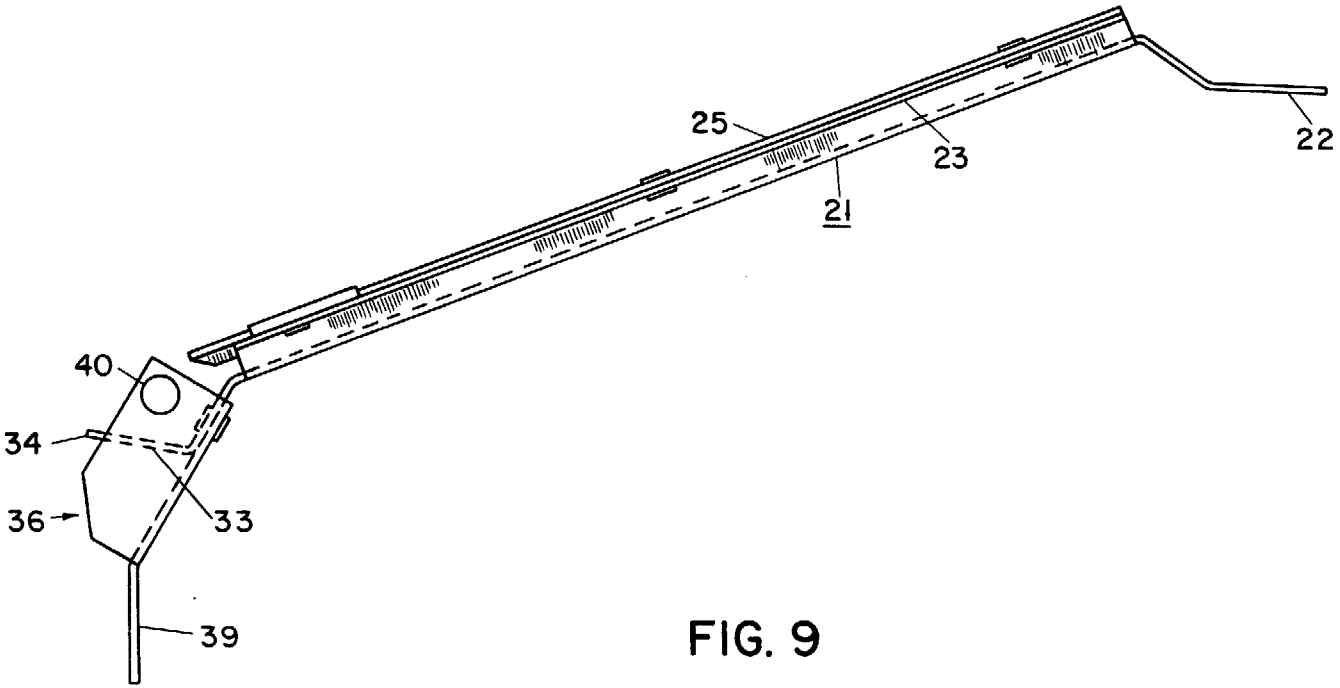
FIG. 9 is a side elevation of the tape channel.

Appropriately guided, the tape T can extend forward over a guide rod 20 and thence down and across a tape channel 21. The tape channel 21 (FIGS. 5, 8, 9) comprises a plate having a downwardly-sloping and rearwardly-bent upper entry flange 22 that fits below the guide rod 20 to keep the end of the tape from initially going below the plate. If the end of the tape does come down toward the entry flange 22, the slope thereof will divert it back over the top of the plate.

The channel 21 has sides 23 and 24 that extend upwardly and then outwardly, and to them are riveted at 28 extension flanges 25 and 26, respectively. The flanges extend over the channel by short distances, so that they may overlie the edges of the tape. A plastic grommet 27 is located in the extension flange 25. The middle part of the plate has a rectangular feed-wheel opening 30 in it with an offset, all for purposes to appear.

In the present case, the channel 21 has a forward extension or lip 33 that is bent downwardly and then forwardly to form a tape diverting projection 34. To this lip 33 is riveted a channel-like tape guide 36. This guide 36 has two upstanding side walls 37 and 38 and a bottom wall 39 that slopes forwardly and downwardly. The lip 34 extends between the two side walls 37 and 38. Also spanning these side walls is a tape diverter rod 40.

The tape channel 21 is secured in place by screws that engage in notches 41 at its upper edge, and by bolts 42 that extend through the lower edge of the bottom wall 39 at the front end of the channel and attach the channel to the front wall of the machine.

Figures 5, 7:
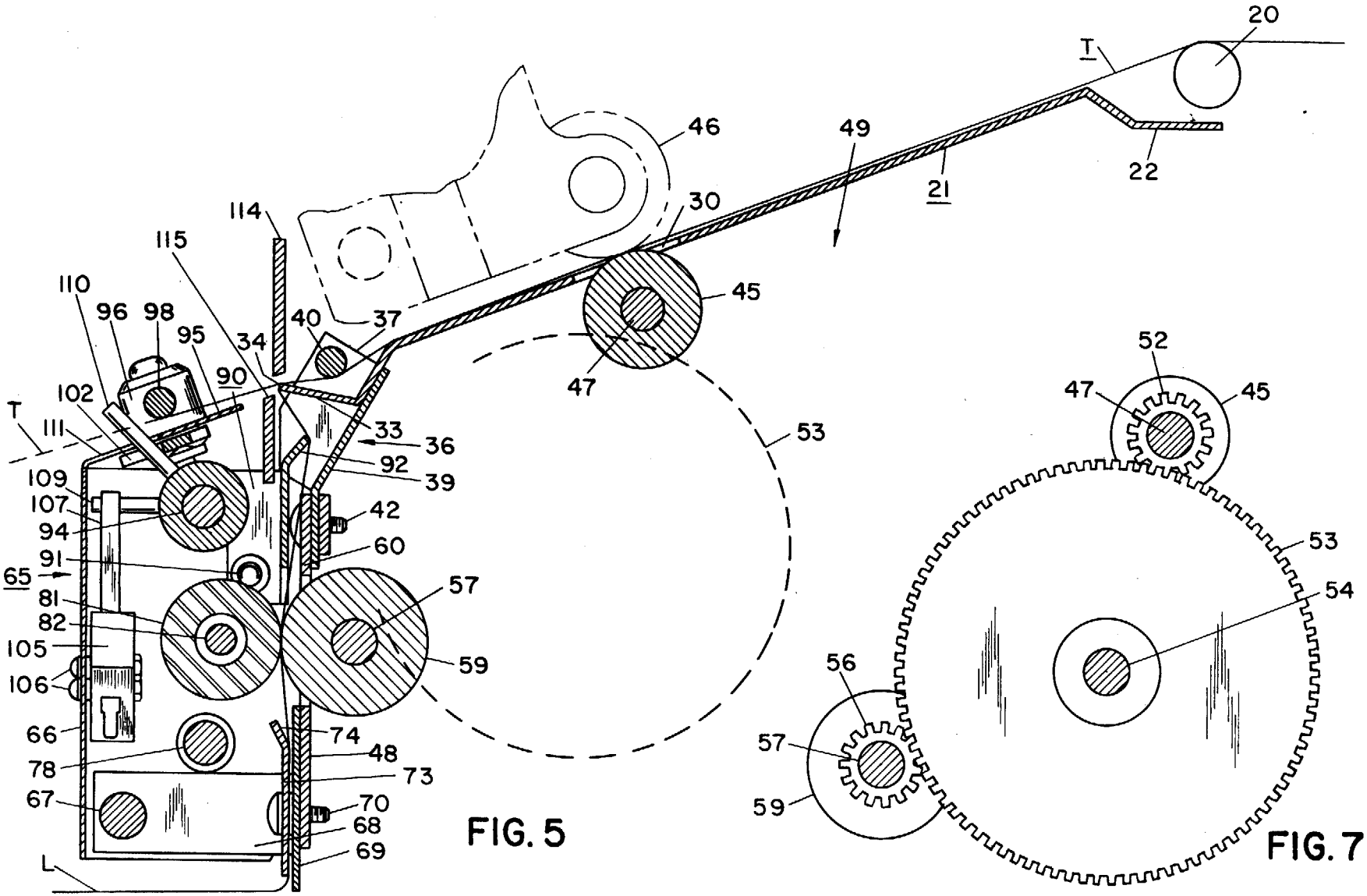
FIG. 5 is a partial medial section of the forward part of the machine, taken approximately on the line 5—5 of FIG. 6.
FIG. 7 is a side elevation partly in section of the gear drive for the two feed wheels.

When the channel is thus in position as shown in FIG. 5, a feed wheel 45 extends through the opening 30 so as to engage the underside of the tape. Over this feed wheel there is a pressure roller 46 mounted as in U.S. Pat. No. 3,924,498 to apply pressure to resiliently urge the tape against the feed roller 45. See also Hempel U.S. Pat. No. 2,845,266. As will be understood from those patents, the feed wheel 45 is mounted on a shaft 47 that is driven by an electric motor.

The shaft 47 extends across and is supported rotatably in the side walls 49 and 50 of the middle section 16 of the machine. On the outside of the side wall 50 a knob 51 is mounted on the shaft 47 to enable it to be turned manually. The motor and clutching mechanisms to drive the shaft are not illustrated here because their arrangements are shown in the patents previously referred to.

Figure 2:
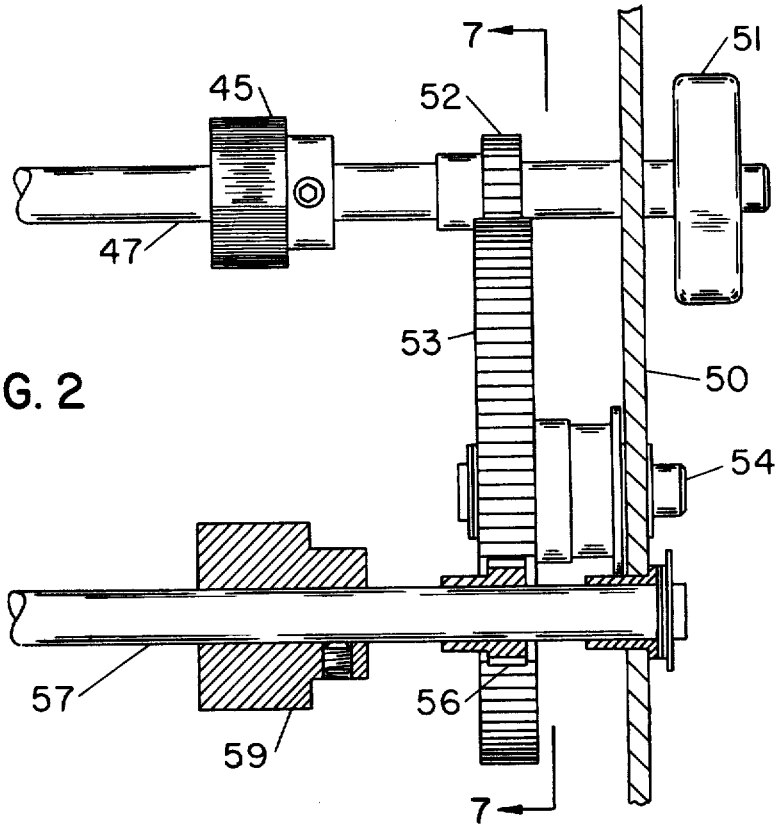
FIG. 2 is a vertical section approximately on the line 2—2 of FIG. 1 showing the feed wheel drive mechanism.
Figure 3:
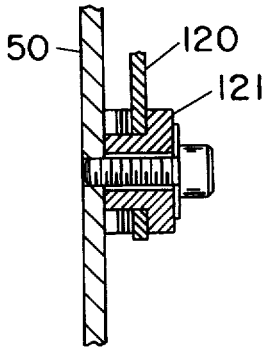
FIG. 3 is a vertical section on the line 3—3 of FIG. 1 showing the latching lever mounting.

The shaft 47 also has a gear 52 on it that meshes with a large gear 53 mounted on a shaft 54 supported in the side wall 50. Appropriate antifriction bearing means are provided for these various rotating components. The big gear 53 in turn meshes with a gear 56 on a shaft 57 (FIG. 2) mounted in the side walls of the machine. The shaft 57 in turn supports a liner tension feed wheel 59, that projects through an opening 60 in the front wall 48 of the machine. The outer diameter of the liner feed wheel 59 is greater than that of the feed wheel 45 so that it has a greater peripheral speed than does the feed wheel 45. It will be understood that these various wheels, save for the large idler gear 53, are secured to their respective shafts, so that rotation of the shaft 47 causes rotation ultimately of the feed wheels 45 and 59. The shaft 47 is in turn rotated either manually by the handle or knob 51 or by electric power through the means of a motor not shown.

On the front wall 48 of the machine is a pressure roller and housing assembly, generally designated at 65. It incorporates a three-sided housing 66 that is supported on a shaft 67. The shaft 67 in turn is supported by a U-shaped bracket 68 that has a bight portion 69. A backing channel 73, having a forwardly bent upper edge 74, is mounted with the bight portion 69. This gives an entrance for the vertically descending tape liner as will appear. Screws 70 are at opposite ends of the bracket 68 and the backing channel 73 (with spacers on the screws between them), attaching the bracket 68 assembly to the front wall 48 of the machine. The liner can pass between the two screws 70. With the housing 66 thus mounted on the shaft 67, it can be tilted outward at its upper end to give access to its interior for initial starting of the machine as well as servicing.

In the lower part of the housing 66, a pressure wheel supporting shaft 78 extends between and is mounted in the side walls of the housing 66 with appropriate bearings. A pressure roller bracket 79 is fixed to the shaft 78 by a set screw 80. The bracket 79 has a short shaft 82 upon which a pressure roller 81 is rotatably mounted with appropriate antifriction bearings.

As appears in FIG. 5, the pressure roller 81 is mounted opposite the liner feed roller 59. It is urged against or toward the liner feed roller 59 by a coil spring 83 surrounding the shaft 78. One end of the spring is mounted in a retainer screw 84 secured in the shaft 78. The other end 86 of the spring 83 extends upwardly and bears against the inside of the front wall of the housing 66. This is a torsion spring and thereby applies force that yieldably urges the pressure roller 81 toward the liner feed roller 59.

Above and slightly rearwardly of the shaft 82 is mounted a U-shaped bracket 90. The side walls of the bracket 90 are mounted by screws 91 onto the side walls of the housing 66. The bight portion of the U-shaped bracket 90 extends parallel to the front wall 48 of the machine and has its upper end bent backwardly to form a keeper lip 92. The bracket 90 can pivot forwardly until its side walls engage a cross shaft 94 to be described. It can pivot oppositely until its bight portion engages the front wall of the machine. The latter movement enables it to be inserted below the cutter blade of the machine.

The tape itself, freed from its liner, is passed forwardly across the top of the pressure roller housing 66. The housing has a downwardly and forwardly sloping top wal portion 95 that supports two mounting posts 96, between which a guide rod 98 is supported a short distance above the upper surface of the wall 95. The top surface of the wall 95 is notched for a purpose to appear.

Figure 4:
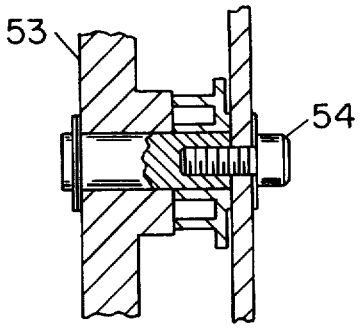
FIG. 4 is a section on the line 4—4 of FIG. 1 showing an idler gear mounting.
Figure 6:
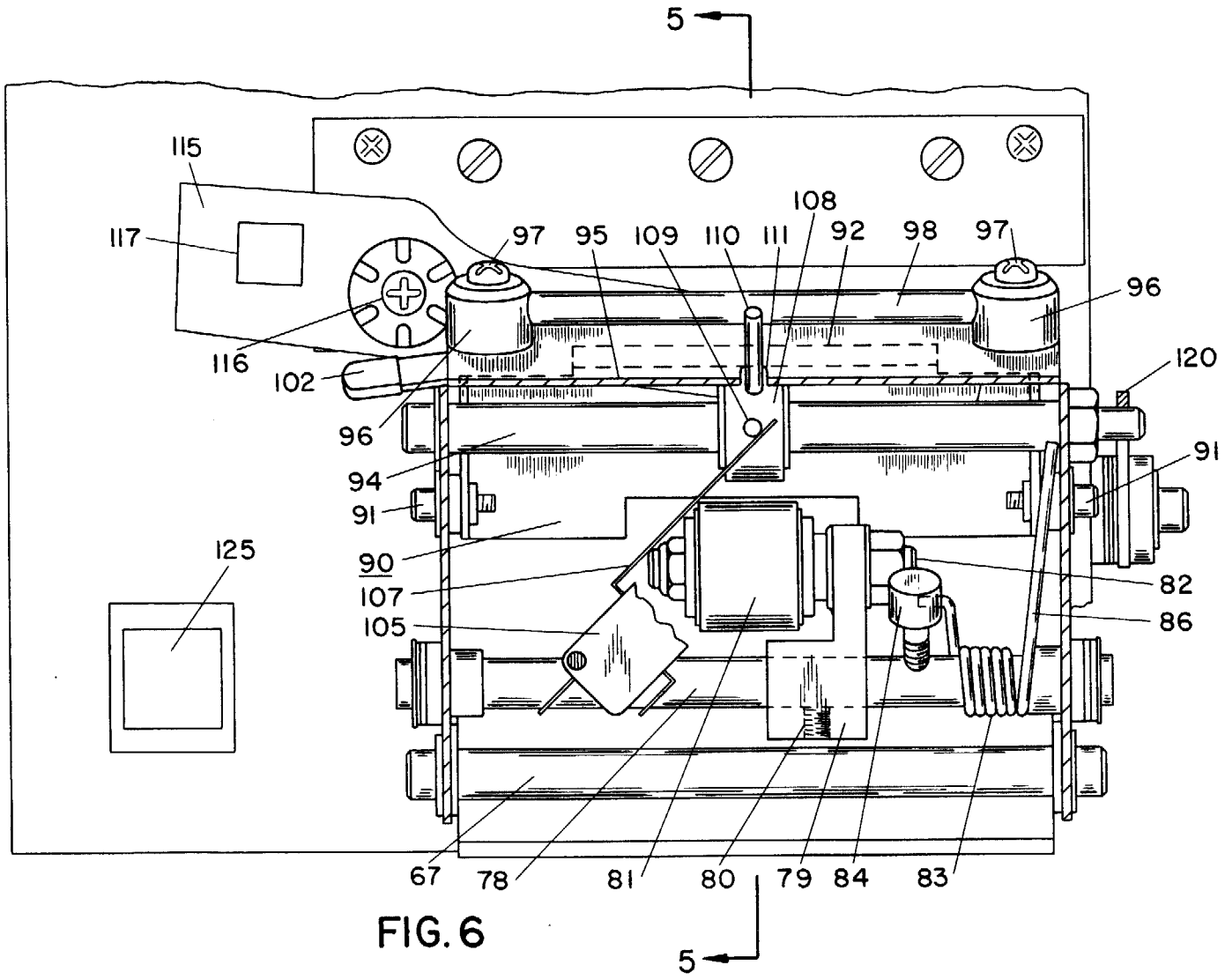
FIG. 6 is a sectional view through the front of the pressure roller housing assembly taken on the line 6—6 of FIG. 1.

A micro switch 105 is mounted on the front wall of the housing 66 by screws 106. It has a resilient switch arm 107 extending upwardly and to the right in FIG. 6, until it is horizontally opposite the middle of the shaft 94. The shaft 94 has a tape feeler hub 108 secured to it. This hub has a first pin 109 extending forwardly to overlie the upwardly and laterally extending switch blade 107 so that if the pin 109 is rocked downwardly, or counterclockwise in FIG. 4, it will depress the resilient blade 107 and operate the switch. The switch normally will return to its initial position when the pin leaves the blade 107.

The hub 108 has another pin 110 that projects upwardly and forwardly through a slot 111 in the top wall 95 of the housing 66, forwardly of the guide rod 98 and in the path of the tape T.

An activating lower blade 102 is pivoted on the screw 97, and extends laterally outside the housing 66 so that the machine can be manually operated. It can be behind the pin 110 as shown in FIG. 5, and can be rocked to cause its inner end to be depressed counterclockwise in FIG. 5, rocking the shaft 94 and causing the other pin 109 to operate the switch 105.

There are knife blades mounted on the front of the machine for severing the tape. An upper blade 114 is fixed to the front wall. A lower blade 115 is rockably mounted on the front wall at 116 and is operated by an operating member 117 as is illustrated in the former patents herein mentioned. When the blade 115 rocks upwardly, it can sever the tape against the fixed blade 114.

It will be observed that the guide rod 40 depresses the tape slightly between the upper surface of the channel 21 and the projecting lip 34. That lip 34 is disposed immediately behind the point of severing of the tape by the knife blade 115. As will appear, the liner is separated at that point.

A latching lever 120 is pivoted onto the side wall of the machine on a pivot assembly 121. The lever extends forwardly across the side of the housing 66 and is notched so that it can engage over the end of the shaft 94 which projects outside the side wall of the housing 66. By this means the housing 66 may be releasably latched against the front wall of the machine, but may be released to swing outwardly about its shaft 67 for service purposes.

There is a two-position selector knob 127 at the top of the machine. It can be positioned to provide for short or long pieces of tape. The circuitry for tape delivery or for short or long tapes can be substantially like that of my U.S. Pat. No. 3,924,498 commonly owned by my assignee hereof. That patent shows an arrangement for selecting from two lengths of tape, for delivery, for delivering tape automatically when a severed strip is lifted off the pin 110.

USE OF THE MACHINE

At the start it will be assumed that a roll of laminated, lined pressure-sensitive tape is in the machine. The pressure roller 46 is elevated off of the feed roller 45 toward which it is strongly urged by a spring means (see U.S. Pat. No. 3,757,730). The latching lever 120 is lifted and the housing 66 is swung forward on the pivot 67. The lower knife blade 115 is down, leaving a space between it and the upper blade 114. The bracket 90 and its keeper 92 is pivoted clockwise from its position in FIG. 5.

Before energizing the electrical components, the tape is then fed down the tape channel 21 with its edges under the overhanging flanges 25 and 26. It passes over the feed roller 45 below the now-elevated pressure roller 46; thence underneath the guide rod 40. The tape should be drawn out to a length several inches beyond the machine. At this time the pressure roller 46 may be lowered onto the tape, pressing it against the feed roller 45. That roller 45 can be turned by the knob 51 if necessary to feed more tape. Then the liner L is separated from the tape by hand for a short distance. The freed end of the liner L is fed around the end 34 of the lip 33, downwardly across the liner feed roller 59, and then through the slot formed between the lip 74 of the backing channel member 73 and the bight portion 69 of the bracket 68. The liner is drawn out beneath those parts and outside of the machine.

The separated tape is drawn forward in the manner indicated by dashed lines in FIG. 5, passing under the guide rod 98. The housing 66 is then swung about the shaft 67 into its upright position and latched by the arm 120. To permit this, the U-bracket 90 is pivoted to dispose the lip 92 in position to pass below the blade 115. When this operation is performed, the keeper lip 92 on the bracket 90 pushes the liner backwardly so that, confined by the rod 40, the edge 34 and the keeper 92, it passes around the edge 34 at an acute angle. This angle should be at least about 90° to the outwardly-extending end of the unlined tape, in order to insure peeling of the liner from various brands of lined tape that can be used in the machine.

The separated end of the tape passes between the knife blades 114 and 115, below the guide rod 98, and forwardly of the machine. If the machine is on automatic operation, the tape is drawn over the actuating pin 110 on the shaft 94, causing that shaft 94 to rock and depress the other rod 109 and actuate the switch 105 into a non-operating condition. The tape T is shown by dashed lines beyond the pin 110, since if it were actually present there, it would depress the pin.

Assuming that the master switch 125 is closed, the machine may be started by lifting the aforementioned strip of tape off the pin 110, or by depressing the switch 126. Either of the foregoing closes a circuit that may be like that shown in U.S. Pat. No. 3,924,498, starting a cycle for the motor M. The two switches 81 and 126 are connected in parallel, but both are in series with an R.C. time delay, arranged like an anti-bounce circuit, so that when one switch is closed, the other is ineffective. Such circuitry is known in the art and need not be described in detail.

The motor M drives the two feed wheels 45 and 59, the latter at a higher peripheral speed than the former. The wheel 45, acting upon the laminated tape, feeds it from the feed roll forward toward the guide bar 40, while the faster feed wheel 59 puts tension on the liner. The tape is stiff enough to project out over the top 94 of the housing 66 but the liner is caused by the arrangements of the guide rod 40, the edge 34, the lip 33, the keeper 92, and the speedier wheel 59, to be drawn at an acute angle away from the tape T and peeled from the tape.

The feed continues until the pre-set amount of tape has been delivered, as far as the knife blade 114. As explained in U.S. Pat. No. 3,924,498, the cycle of operation, once started, continues to completion even though a new strip of tape advances once again to depress the pin 110. At this time the feed wheels 45 and 59 stop and the cutter blade 115 is raised to cut the tape off against the blade 114. The liner is not cut. The tape with its exposed pressure-sensitive surface downward, then rests upon the upper surface of the top 95 of the housing 66 that is notched so that the tape adheres lightly thereto in a multiplicity of spot areas. In this position, the tape holds the pin 110 down maintaining the motor inoperative until the tape is lifted off of the housing 66 by the user.

As soon as the tape is picked up by the user, it will release the pin 110 and the resilient force of the spring blade 107 and the return spring of the switch 105 will pivot the hub 108, which is very freely mounted on the shaft 94, upwardly, again starting a new cycle.

It it is desired to operate the machine manually, the lever 102 may be moved, sweeping the pin 110 downwardly to hold the power off of the drive for the tape. Thereafter the operation cycle is started only by the manual switch 127.

By having the tape fed by the wheel 45, the load of drawing it from the supply roll is cared for and does not have to be taken by the liner feed roll 59. That roll is required only to supply tension to the liner. The separation involves the following factors. The separation is produced at a relatively sharp edge 34, by a force on the liner applied at a sharp angle, greater than 90° to the projecting strip of separated tape. The stiffness of the tape provides a resistance to the peeling force, and resists the tendency of the tape to follow the liner. The sharper the angle, the easier the separation and the less the downward force tending to draw the tape down with the liner.

The fact that the tape projecting forward of the edge 34 does not have to span a wide gap before it can receive support from the top 95 of the housing 66 provides a kind of safety factor reducing any incidental tendency of the tape to follow the liner.

One feature of the present invention is that it can be used as an alternative to a standard tape dispensing machine with or without printing. If the housing 66 and its associated parts are removed, and the drive through the gear 53 to the shaft 57 and the wheel 59 are withdrawn, then the more conventional type of wetting device for glued tape or other types of mechanisms may be attached to the front wall of the machine in place of the present mechanism. Also, the machine can be used with unlined tape. Usually this will involve disabling the switch 107 by the lever 102, where otherwise the severed piece of tape might fall to the floor. Nor is the machine limited to acting upon paper or cellophane tape. It could be used with cloth tape or other such materials.

Various changes and modifications may be made with this invention as will be readily apparent to those skilled in the art. Such changes and modifications are within the scope and teaching of this invention as defined by the claims appended hereto.

What is claimed is:

1. In a tape-feeding machine for removing the liner from a laminated pressure-sensitive tape having a liner on the adhesive face of the tape: means for engaging the laminated tape and for applying a forward force to the same, for positively feeding the laminated tape at a predetermined speed toward the location where the liner can be peeled off the tape, the said feeding means being adjacent the said location; means at the said location for directing the tape in one direction; means for directing the liner in a direction at an angle of at least about 90° from the tape for peeling the liner from the tape; means for positively engaging the liner, pulling the liner, and putting it under tension as it is drawn from the tape; and motor means for causing simultaneous continuous movement of the feeding and pulling means whenever they are operated.

2. In the machine of claim 1: the means for directing the liner including a lip adjacent the path of the tape, over which the liner is pulled at the angle greater than 90°.

3. In the machine of claim 1: the feeding means comprising a tape feed wheel engaging the tape and having a predetermined continuous peripheral speed, and the means for pulling the liner comprising a liner feed wheel engaging the liner and having a higher simultaneous peripheral speed than that of the tape feed wheel.

4. In the machine of claim 3: motor means for driving the feed wheels.

5. In the machine of claim 4: the motor means comprising a single motor and gear means driven from the motor, geared to both feed wheels.

6. In the machine of claim 1: means for cutting the tape downstream from the location where the liner is peeled away.

7. In the machine of claim 1: the means for directing the liner including a member having a lip edge over which the tape is drawn, and means having a keeper for engaging the tape downstream of the lip edge, the keeper being located between the lip edge and the means for engaging and pulling the liner to engage the liner in the face thereof opposite that drawn over the lip edge and force it under tension against the edge, so that it leaves the tape at the angle greater than 90°.

8. In the machine of claim 7: a guide upstream of the lip edge to confine the laminated tape to a predetermined angle of approach to the lip edge.

9. In the machine of claim 7: guide means engaging the tape for directing the laminated tape in a predetermined direction; the lip edge being downstream of the guide means, and across which the guide means directs the tape, and the means for directing the liner including means for pulling it across the lip edge at the angle of at least 90° to the tape, the cutting means being closely downstream from the lip edge.

10. In the tape-feeding machine of claim 2: a motor-driven tape feeding wheel upstream of the lip feeding the laminated tape toward the lip; the means for pulling the liner including a liner feed wheel engaging the liner downstream of the lip, and the liner feed wheel being connected for being motor driven by the same motor but at a faster peripheral speed than the tape feeding wheel.

11. In the machine of claim 10: the machine having a front wall, a housing pivotally attached to the front wall; the liner feed wheel projecting through the front wall, an idler wheel on the housing yieldably urged toward the liner feed wheel to compress the liner against the feed wheel; the housing having also a keeper element engageable with the liner below the lip edge, to force the tape backward from the lip and increase the angle of the liner relative to the tape.

12. In the machine of claim 11: the housing having a liner-receiving slot downstream of the liner feed wheel, to receive the liner and direct it from the housing.

13. In the machine of claim 10: the machine having a front wall toward and through which the tape is directed, a housing in the front wall; the housing having a top wall and side walls; the liner pulling means including parts in the housing; a switch in the housing operable to cause a feeding cycle for the tape; actuating means for the switch including a movable pin projecting through the top wall of the housing to be moved by the tape projecting from the lip edge.

14. In the machine of claim 13: the top wall of the housing having a mottled surface to which pressure-sensitive tape may adhere lightly when severed.

15. In a tape feeding machine for feeding laminated tape having a tape portion adhered to a liner, and for separating the liner from the tape portion: a housing having an upper wall and a front wall, first impelling means on the upper wall to impel the laminated tape toward the front wall, second separation means downstream of the impelling means to separate the tape portion from the liner; drawing means on the front wall to draw the separated liner from the separation means; the drawing means providing a linear speed for the liner greater than the linear speed applied by the impelling means to the laminated tape.

16. The machine of claim 15, wherein each of the impelling means and the drawing means comprises a feed wheel.

17. The machine of claim 16, wherein there is a drive shaft adapted to be power driven, and gearing connecting that drive shaft to both fed wheels together.

18. The machine of claim 15, wherein the upper wall comprises a plate removable from the housing, the plate having tape-guides at its edges, and having an edge around which the laminated tape is drawn to withdraw the liner from the tape portion.

19. The machine of claim 16, with support means adjacent the separation means to support the separated tape portion; control mechanism operated by the presence and absence of the tape portion at the support means; a motor for operating at least one of the first and second means, the control means causing operation of the motor when the tape is absent from the support means.

* * * * *